US009121627B2

(12) United States Patent
Kopko et al.

(10) Patent No.: US 9,121,627 B2
(45) Date of Patent: Sep. 1, 2015

(54) SYSTEM AND METHOD FOR CONTROLLING AN ECONOMIZER CIRCUIT

(75) Inventors: William L. Kopko, Jacobus, PA (US); Andrew John Graybill, Hellam, PA (US); Glenn Eugene Nickey, New Oxford, PA (US); Israel Federman, York, PA (US); Satheesh Kulankara, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 358 days.

(21) Appl. No.: 13/820,639

(22) PCT Filed: Sep. 14, 2011

(86) PCT No.: PCT/US2011/051559

§ 371 (c)(1), (2), (4) Date: Mar. 4, 2013

(87) PCT Pub. No.: WO2012/037223

PCT Pub. Date: Mar. 22, 2012

(65) Prior Publication Data

US 2014/0013782 A1 Jan. 16, 2014

Related U.S. Application Data

(60) Provisional application No. 61/382,858, filed on Sep. 14, 2010.

(51) Int. Cl.

| | |
|---|---|
| ***F25B 1/06*** | (2006.01) |
| ***A63B 57/00*** | (2015.01) |
| ***F25B 41/00*** | (2006.01) |
| ***F25B 49/02*** | (2006.01) |

(52) U.S. Cl.

CPC . *F25B 1/06* (2013.01); *A63B 57/00* (2013.01); *F25B 41/00* (2013.01); *F25B 49/025* (2013.01); *F25B 2400/13* (2013.01); *F25B 2600/01* (2013.01); *F25B 2600/02* (2013.01); *F25B 2600/2509* (2013.01); *F25B 2700/04* (2013.01); *F25B 2700/2106* (2013.01); *F25B 2700/21156* (2013.01)

(58) Field of Classification Search

CPC ..... F25B 1/06; F25B 41/00; F25B 49/025; F25B 2400/13; F25B 2600/01; F25B 2600/02; F25B 2600/2509; F25B 2700/2106; F25B 2700/21156; A63B 57/00

See application file for complete search history.

(56) References Cited

U.S. PATENT DOCUMENTS

| | | | | |
|---|---|---|---|---|
| 2005/0235689 | A1 | 10/2005 | Lifson et al. | |
| 2005/0247071 | A1 * | 11/2005 | Nemit | 62/197 |
| 2005/0262859 | A1 | 12/2005 | Crane et al. | |
| 2009/0165482 | A1 * | 7/2009 | Ko et al. | 62/222 |

* cited by examiner

*Primary Examiner* — Marc Norman

(74) *Attorney, Agent, or Firm* — McNees Wallace & Nurick LLC

(57) ABSTRACT

A system and method for controlling an economizer circuit is provided. The economizer circuit includes a valve to regulate refrigerant flow between the economizer and the compressor. The valve can be opened to engage the economizer circuit or closed to disengage the economizer circuit based on the output frequency provided to the compressor motor by a variable speed drive and an operating condition of the economizer.

14 Claims, 7 Drawing Sheets

SYSTEM AND METHOD FOR CONTROLLING AN ECONOMIZER CIRCUIT

CROSS-REFERENCE TO RELATED APPLICATIONS

This application claims priority from and the benefit of U.S. Provisional Application No. 61/382,858, entitled SYSTEM AND METHOD FOR CONTROLLING AN ECONOMIZER CIRCUIT, filed Sep. 14, 2010 which is hereby incorporated by reference.

BACKGROUND

The present application relates generally to controlling an economizer circuit in a vapor compression system. More specifically, the present application relates to controlling the economizer circuit of a vapor compression system by controlling a valve for the economizer port of a compressor.

In vapor compression systems such as refrigeration and chiller systems, a refrigerant gas is compressed by a compressor and then delivered to a condenser. The refrigerant vapor delivered to the condenser enters into a heat exchange relationship with a fluid, e.g., air or water, and undergoes a phase change to a refrigerant liquid. The liquid refrigerant from the condenser flows through a corresponding expansion device(s) to an evaporator. The liquid refrigerant in the evaporator enters into a heat exchange relationship with another fluid, e.g. air, water or other process fluid, and undergoes a phase change to a refrigerant vapor. The other fluid flowing through the evaporator is chilled or cooled as a result of the heat exchange relationship with the liquid refrigerant and can then be provided to an enclosed space to cool the enclosed space. Finally, the vapor refrigerant in the evaporator returns to the compressor to complete the cycle.

To provide increased capacity, efficiency and performance of the refrigeration or chiller system, an economizer circuit can be incorporated into the system. An economizer circuit can include an economizer heat exchanger or flash tank, an inlet line to the economizer heat exchanger or flash tank that is connected to the condenser or to the main refrigerant line downstream of the condenser, and an economizer expansion device, which is incorporated in the inlet line. When the economizer circuit includes a flash tank, a first outlet line from the flash tank can be connected to the main refrigerant line upstream of the expansion device, and a second outlet line from the flash tank that can be connected to a port within the compression chamber of the compressor or to the suction inlet of the compressor.

In flash tank economizer circuits, liquid refrigerant from the condenser flows through the inlet line and expansion device into the flash tank. Upon passing through the expansion device, the liquid refrigerant experiences a pressure drop, whereupon, at least a portion of the refrigerant rapidly expands or "flashes" and is converted from a liquid to a gas. The liquid refrigerant in the flash tank collects at the "bottom" of the flash tank and returns to the main refrigerant circuit through the first outlet line. The first outlet line may incorporate one or more valves to control the amount of liquid refrigerant returned to the main refrigerant circuit. The gaseous refrigerant in the flash tank collects at the "top" of the flash tank and returns to the compressor through the second outlet line to either the suction inlet or a point in the compression chamber operating at an intermediate pressure. The second outlet line may also incorporate one or more valves to control the amount of gaseous refrigerant provided to the compressor.

As discussed above, an economizer circuit can be used to provide increased capacity, efficiency and performance of the refrigeration or chiller system. For example, the economizer circuit can improve system efficiency by providing refrigerant gas at an intermediate pressure to the compressor, thereby reducing the amount of work required by the compressor and increasing compressor efficiency. A variety of parameters in the economizer circuit can be controlled to provide the increased capacity, efficiency and performance of the refrigeration or chiller system. The amounts of refrigerant entering and leaving the flash tank can be controlled, as well as the amount of liquid refrigerant maintained in the tank, to obtain the desired capacity, efficiency and performance of the refrigeration or chiller system.

There are two basic types of economizers that can be used in a refrigeration or chiller system. The first type of economizer uses a flash tank to cool refrigerant liquid by boiling a portion of the refrigerant and providing sufficient space to separate the liquid and gas phases. The cooled refrigerant liquid continues to an evaporator and the refrigerant vapor goes into the compressor. A solenoid valve can be used to regulate the flow on the vapor line between the flash tank and the compressor. A description of a flash tank economizer is described in U.S. Pat. No. 7,353,659, which patent is incorporated herein by reference. A second type of economizer uses a heat exchanger with subcooled refrigerant liquid on one side and boiling refrigerant on the other side. An expansion valve modulates the flow of the liquid refrigerant on the boiling side of the heat exchanger. The expansion valve can be controlled to maintain a constant superheat of refrigerant vapor leaving the heat exchanger. In other cases, the expansion valve can be controlled to maintain a constant compressor suction pressure or cooling capacity.

One problem with refrigeration or chiller systems involves the use of a variable speed drive to reduce compressor speed in response to high compressor motor current conditions. The problem is that reducing the frequency of voltage supplied to the compressor motor does not reduce the motor current for a given condensing temperature. Relatively large reductions in motor speed, which is related to the supply frequency from the variable speed drive, are required to reduce the condenser load and thereby reduce the motor current. The motor speed approach for compressor unloading results in a much larger reduction in cooling capacity than would be required with other techniques such as slide valve unloading in a screw compressor.

Therefore, what is needed is a system and method to control motor current while still maintaining a desired amount of cooling capacity. More specifically, what is needed is a system and method for simply and easily controlling an economizer circuit to provide improved performance to a refrigeration or chiller system while controlling motor current.

SUMMARY

The present invention is directed to a method for controlling an economizer circuit having a flash tank, an inlet line to the flash tank from a condenser and an outlet line from the flash tank connected to a compressor. The method includes measuring a liquid level in a flash tank, comparing the measured liquid level to a predetermined level, measuring an operating parameter of a compressor and comparing the measured operating parameter to a first predetermined value corresponding to the measured operating parameter. The method also includes opening a valve positioned in an outlet line from the flash tank in response to the measured liquid level being less than the predetermined level and the measured operating parameter being greater than the first predetermined value. The outlet line from the flash tank is connected to an economizer port of the compressor and the opening of the valve permits the flow of refrigerant from the flash tank to the compressor.

The present invention is also directed to a method for controlling an economizer circuit having a flash tank, an inlet line to the flash tank from a condenser and an outlet line from the flash tank connected to a compressor. The method includes measuring a liquid level in a flash tank, comparing the measured liquid level to a predetermined level, comparing an outdoor ambient temperature with a predetermined temperature and comparing a compressor operating time to a predetermined time period. The method also includes opening a valve positioned in an outlet line from the flash tank in response to the outdoor ambient temperature being less than the predetermined temperature, the compressor operating time being less than the predetermined time period and the measured liquid level being less than the predetermined level. The opening of the valve permits the flow of refrigerant from the flash tank to the compressor.

The present invention is further directed to a system having a first circuit including a compressor having a motor, a condenser, an expansion valve and an evaporator connected in a closed refrigerant loop. The system also has a second circuit connected to the first circuit. The second circuit includes a flash tank in fluid communication with the condenser, an outlet line from the flash tank in fluid communication with the compressor, and a valve positioned in the outlet line to control the flow of refrigerant from the flash tank to the compressor. The system further has a variable speed drive to provide an output frequency to the compressor motor, a sensor to determine a level of liquid refrigerant in the flash tank and a controller. The controller includes a first connection to receive the determined level of liquid refrigerant in the flash tank from the sensor, a second connection to receive the output frequency provided by the variable speed drive and a microprocessor to execute a computer program to generate a signal to control the position of the valve based on the determined level of liquid refrigerant in the flash tank from the first connection and the output frequency provided by the variable speed drive from the second connection. The controller generates a signal to open the valve in response to the determined level of liquid refrigerant being less than a predetermined level and the output frequency provided by the variable speed drive being greater than a predetermined frequency.

The present invention is additionally directed to method for controlling an economizer circuit having a vessel, an inlet line to the vessel from a condenser and an outlet line connecting the vessel and a compressor. The method includes measuring an operating parameter associated with a compressor, comparing the measured operating parameter to a predetermined value corresponding to the measured operating parameter and incrementally closing a valve in response to the measured operating parameter being greater than the predetermined value. The valve being positioned in an outlet line fluidly connecting a vessel in an economizer circuit and an economizer port of the compressor. The incrementally closing of the valve restricts flow of refrigerant from the vessel to the compressor.

Some additional embodiments of the method include the measuring an operating parameter including measuring at least one of a compressor motor temperature, a compressor motor current or a discharge pressure of the compressor; the vessel including a flash tank and the measuring an operating parameter including measuring a level of liquid in the flash tank; and the incrementally closing a valve including incrementally closing the valve by an amount proportional to a difference between the measured operating parameter and the predetermined value.

The present invention is also directed to a system having a first circuit including a compressor with a motor, a condenser, an expansion valve and an evaporator connected in a closed refrigerant loop and a second circuit connected to the first circuit. The second circuit includes a vessel in fluid communication with the condenser and the compressor and a valve positioned to control flow of refrigerant from the vessel to the compressor. The system also includes a sensor to measure an operating parameter of the system and a controller. The controller includes a connection to receive the measured operating parameter from the sensor and a microprocessor to execute a computer program to generate a signal to control the position of the valve based on the measured operating parameter from the connection. The controller generates a signal to incrementally close the valve in response to the measured operating parameter being greater than a predetermined value associated with the measured operating parameter.

Some additional embodiments of the system relate to the measured operating parameter including at least one of a compressor motor temperature, a compressor motor current or a discharge pressure of the compressor; the vessel including one of a flash tank or a heat exchanger; and the vessel being a flash tank and the measured operating parameter being a level of liquid in the flash tank.

One embodiment of the present application includes a method for controlling an economizer circuit in a chiller system. The method includes the steps of providing an economizer circuit for a chiller system having a flash tank, an inlet line to the flash tank and an outlet line from the flash tank connected to an economizer port of a compressor of the chiller system. The outlet line includes a valve to control the flow of refrigerant in the outlet line. The method also includes the steps of determining whether a level of liquid in the flash tank is less than a predetermined level and determining whether an operating parameter of the compressor is greater than a first predetermined value related to the operating parameter of the compressor. The method further includes the step of actuating the valve to engage the economizer circuit in response to a determination that the liquid level in the flash tank is less than the predetermined level and a determination that the operating parameter of the compressor is greater than the first predetermined value related to the operating parameter of the compressor.

Another embodiment of the present application includes a chiller system with a refrigerant circuit having a compressor, a condenser arrangement, an expansion valve and an evaporator arrangement connected in a closed refrigerant loop. The chiller system also includes an economizer circuit connected to the refrigerant circuit. The economizer circuit includes a flash tank having a first outlet line in fluid communication with the expansion valve and a second outlet line in fluid communication with the compressor. The second outlet line includes a valve to control the flow of refrigerant from the flash tank to the compressor. The chiller system further includes a control panel to control the valve to activate and deactivate the economizer circuit. The control panel is configured to open the valve to activate the economizer circuit in response to a liquid level in the flash tank being less than a predetermined level and an operating parameter of the compressor being greater than a first predetermined value related to the operating parameter of the compressor.

Still another embodiment of the present application includes a method for controlling an economizer circuit in a chiller system. The method includes the step of providing an economizer circuit for a chiller system having a flash tank, an inlet line to the flash tank and an outlet line from the flash tank connected to an economizer port of a compressor of the chiller system. The outlet line includes a valve to control the flow of refrigerant in the outlet line. The method also includes the steps of determining whether an outdoor ambient temperature is less than a predetermined temperature, determining whether an operating time for the compressor is less than a predetermined time period and determining whether an operating parameter of the compressor is greater than a first predetermined value related to the operating parameter of the compressor. The method further includes the step of actuating the valve to engage the economizer circuit in response to a determination that the operating parameter of the compressor is greater than the first predetermined value related to the operating parameter of the compressor and a determination that the outdoor ambient temperature is less than a predetermined temperature and a determination that the operating time for the compressor is less than a predetermined time period.

A further embodiment of the present application includes a refrigeration system having: a flash tank; a compressor with a port at an intermediate pressure between the suction and discharge pressures of the compressor; a sensor to measure a system condition that may exceed a predetermined system limit; a valve located in the flow path between the flash tank and the compressor that modulates the flow of refrigerant vapor between the compressor and the flash tank; and a controller in communication with the sensor and the valve to modulate the position of the valve in response to the output of the sensor so as to prevent a condition that may exceed the predetermined system limit.

One embodiment of the refrigeration system is directed to the sensor including a flash-tank liquid-level sensing device. Another embodiment of the refrigeration system is directed to the sensor including a flash-tank liquid-level switch. A further embodiment of the refrigeration system is directed to the sensor including a compressor motor temperature sensor. Yet another embodiment of the refrigeration system is directed to the sensor including a compressor motor current sensor. Still another embodiment of the refrigeration system is directed to the sensor including a compressor discharge temperature sensor. One other embodiment of the refrigeration system is directed to the sensor including a compressor discharge pressure sensor.

One advantage of the present application is that the operation of the economizer circuit can be controlled by opening and closing a solenoid valve for the economizer port of the compressor.

Another advantage of the present application is that both compressor and system performance can be enhanced by selectively operating the economizer circuit in response to predetermined conditions.

Still another advantage of the present application is that refrigerant can be circulated faster in the system during a startup of the system in low ambient temperature conditions.

Additional advantages of the present application include the ability to maximize cooling capacity at high ambient conditions. The control system and method permit the compressor to unload in response to a high motor current or other conditions without a large reduction in cooling capacity associated with reducing compressor speed.

Additional advantages of the present application include the prevention of conditions that may damage the compressor or other system components. The control system and method prevent operation of the system with excessively high flash tank liquid levels, high compressor discharge temperatures or pressures, high compressor motor currents, or high compressor motor temperatures that should provide improved compressor reliability.

Additional advantages of the present application include a low cost. The system cost per unit of cooling capacity is especially attractive at high ambient temperature conditions without the requirement of expensive and unreliable compressor unloading mechanisms such as slide valves.

DETAILED DESCRIPTION OF THE EXEMPLARY EMBODIMENTS

Figure 1:
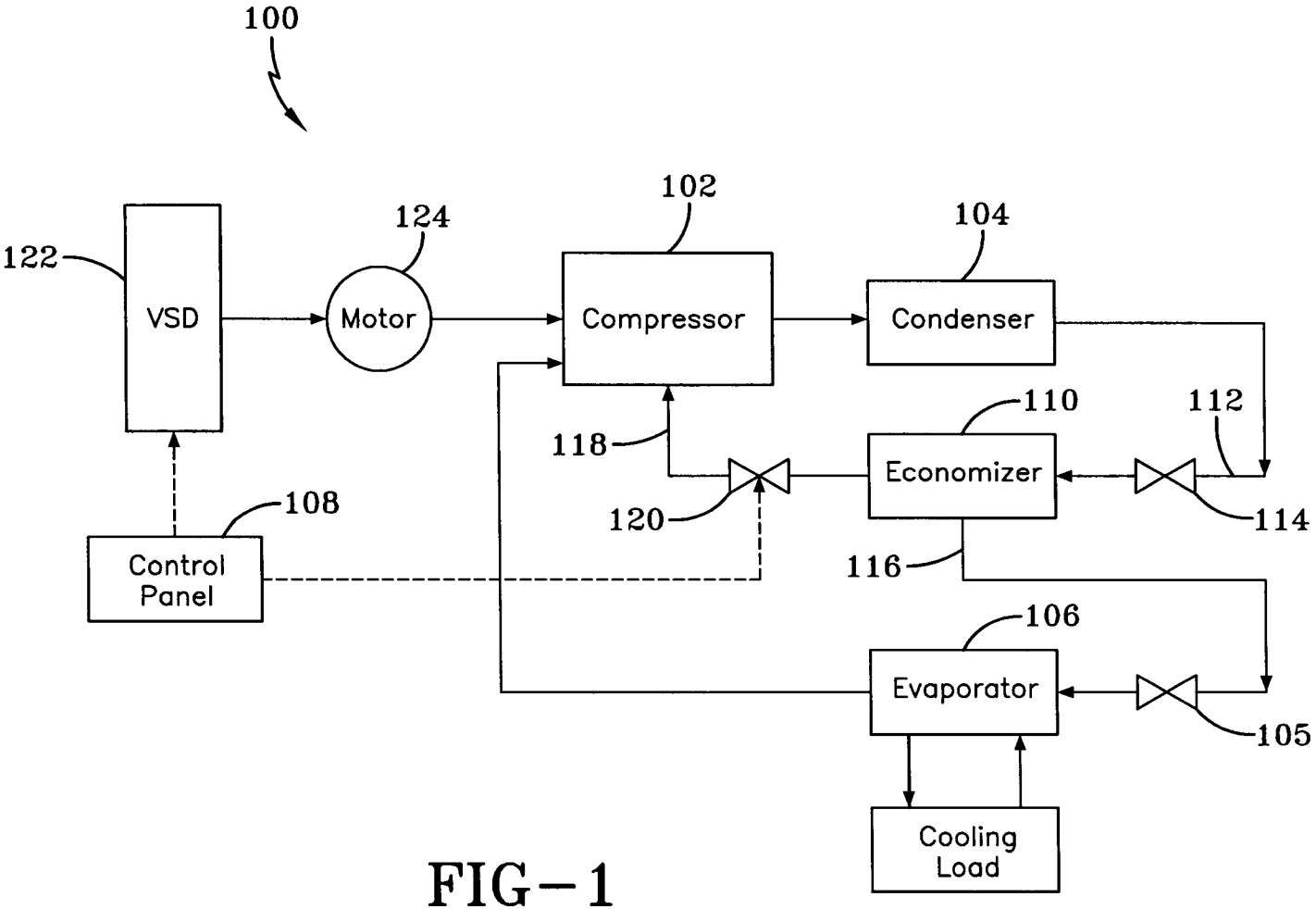
FIG. 1 illustrates an embodiment of a vapor compression system.

FIG. 1 illustrates a vapor compression system that can incorporate the economizer port valve control system and method of the present application. As shown in FIG. 1, a heating, ventilation, and air conditioning (HVAC), refrigeration or liquid chiller system 100 includes a compressor 102, a condenser 104, an expansion device(s) 105, a liquid chiller or evaporator 106 and a control panel or controller 108. The compressor 102 can be driven by a motor 124 that is powered by a variable speed drive (VSD) 122. In addition, the system 100 as shown in FIG. 1 can have an economizer circuit that includes a flash tank 110, an inlet line 112, an economizer expansion valve 114, a first outlet line 116, a second outlet line 118 and a port valve 120.

The VSD 122 receives AC power having a particular fixed line voltage and fixed line frequency from an AC power source and provides AC power to the motor 124 at desired voltages and desired frequencies, both of which can be varied to satisfy particular requirements. The motor 124 can be any suitable motor that can be operated at variable speeds such as an induction motor, a switched reluctance motor or an electronically commutated permanent magnet motor.

The compressor 102, driven by the motor 124, compresses a refrigerant vapor and delivers the vapor to the condenser 104 through a discharge line. The compressor 102 can be any suitable type of compressor such as a screw compressor, a centrifugal compressor, a reciprocating compressor, or a scroll compressor. The refrigerant vapor delivered by the compressor 102 to the condenser 104 enters into a heat exchange relationship with a fluid, e.g., air or water, and undergoes a phase change to a refrigerant liquid as a result of the heat exchange relationship with the fluid. The condensed liquid refrigerant from the condenser 104 flows through the economizer circuit to the expansion device 105 and then to an evaporator 106.

The evaporator 106 can include connections for a supply line and a return line of a cooling load. A process fluid, e.g., water, ethylene glycol, calcium chloride brine or sodium chloride brine, travels into the evaporator 106 via return line and exits the evaporator 106 via the supply line. The liquid refrigerant in the evaporator 106 enters into a heat exchange relationship with the process fluid to lower the temperature of the process fluid. The refrigerant liquid in the evaporator 106 undergoes a phase change to a refrigerant vapor as a result of the heat exchange relationship with the process fluid. The vapor refrigerant in the evaporator 106 exits the evaporator 106 and returns to the compressor 102 by a suction line to complete the cycle or circuit.

The economizer circuit can be incorporated in the main refrigerant circuit between the condenser 104 and the expansion device 105. The economizer circuit has an inlet line 112 that is either connected directly to or is in fluid communication with the condenser 104. The inlet line 112 has an economizer expansion valve 114 upstream of the flash tank 110. The economizer expansion valve 114 operates to lower the pressure of the liquid refrigerant from the condenser 104 flowing through the economizer expansion valve 114. Downstream of the economizer expansion valve 114, both liquid refrigerant and gaseous refrigerant enters the flash tank 110. Inside the flash tank 110, gaseous refrigerant can collect in the "top" or "upper" portion of the flash tank 110 and the liquid refrigerant can settle in the "bottom" or "lower" portion of the flash tank 110.

The liquid refrigerant in the flash tank 110 then flows or travels through the first outlet line 116 to the expansion valve 105. The second outlet line 118 can return the gaseous refrigerant in the flash tank 110 to an economizer port in the compressor 102 connected directly to a compression chamber of the compressor 102 or to the suction inlet of the compressor 102. The second outlet line 118 includes at least one economizer port valve 120 to control the flow of gaseous refrigerant from the flash tank 110 to the compressor 102. The economizer port valve 120 can be a solenoid valve, however any suitable type of valve can be used including a valve that can be variably adjusted and incrementally adjusted (stepped), between an open position and a closed position. In another exemplary embodiment, the economizer circuit can operate in a similar manner to that discussed above, except that instead of receiving all of the refrigerant from the condenser 104, as shown in FIG. 1, the economizer circuit receives only a portion of the refrigerant from the condenser 104 and the remaining refrigerant proceeds directly to the expansion device 105.

In one exemplary embodiment, some examples of fluids that may be used as refrigerants in the system 100 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In another exemplary embodiment, the system 100 may use one or more of each of variable speed drives (VSDs) 122, motors 124, compressors 102, condensers 104, expansion valves 105 and/or evaporators 106.

The control panel 108 can include an analog to digital (A/D) converter, a microprocessor, a non-volatile memory, and an interface board to control operation of the system 100. The control panel 108 can execute a control algorithm(s), a computer program(s) or software to control operation of the system 100 and to determine and implement an operating configuration for the economizer port valve 120 to engage and disengage the economizer circuit. In one embodiment, the control algorithm(s) can be computer programs or software stored in the non-volatile memory of the control panel 108 and can include a series of instructions executable by the microprocessor of the control panel 108. In another embodiment, the control algorithm may be implemented and executed using digital and/or analog hardware by those skilled in the art. If hardware is used to execute the control algorithm, the corresponding configuration of the control panel 108 can be changed to incorporate the necessary components and to remove any components that may no longer be required.

FIGS. 2-5 illustrate embodiments of the economizer port valve control process of the present application. The valve control process can be initiated in response to a starting command or an instruction from a capacity control process or other control program for the system. The economizer port valve control process can be a stand-alone process or program or it can be incorporated into a larger control process or program, such as a capacity control program for the system.

Figure 2:
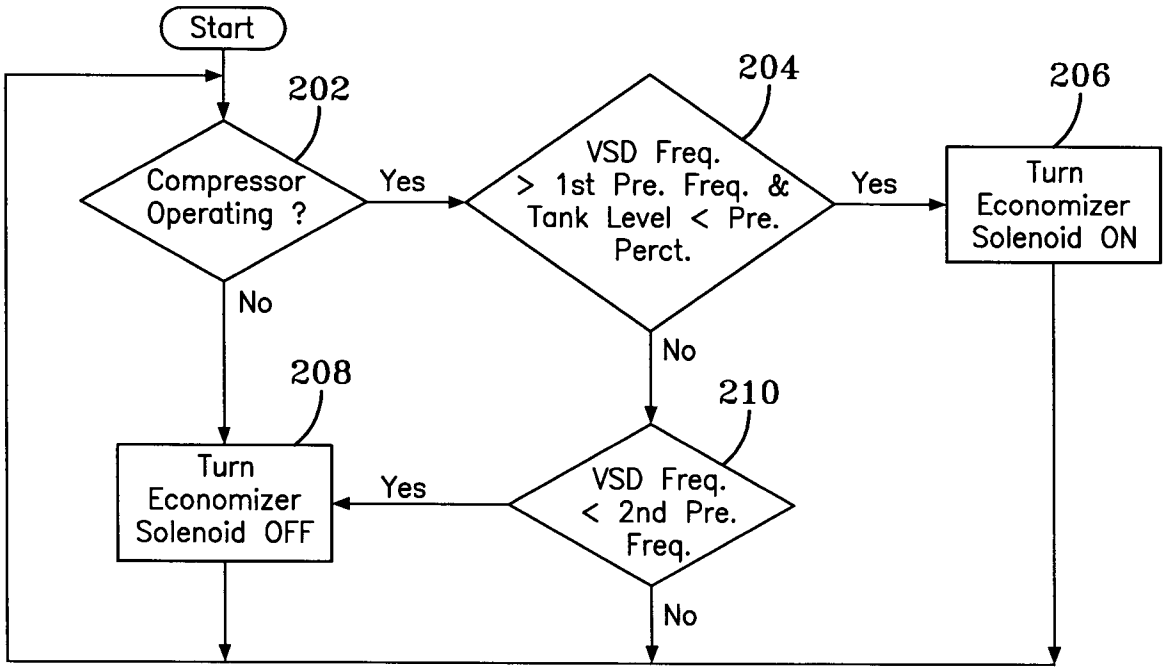
FIG. 2 is a flowchart showing an embodiment of an economizer port valve control process.

The process in FIG. 2 begins by determining if the compressor 102 is in operation (step 202). If the compressor 102 is not operating, then the economizer port valve 120 is turned "off" or closed (step 208) to disengage the economizer circuit and the control process restarts. However, if the compressor 102 is in operation, then a determination is made as to whether the VSD 122 is providing an output frequency to the motor 124 and compressor 102 greater than a first predetermined frequency and whether the level of liquid refrigerant in the flash tank 110 is less than a predetermined flash tank liquid level percentage (step 204). The first predetermined frequency can be between about 50 Hz and about 200 Hz and in one embodiment can be about 120 Hz. The predetermined flash tank liquid level percentage is a value that is determined based on the particular technique or device that is used to measure the liquid level in the flash tank. In other words, the same level of liquid in the flash tank can have different predetermined flash tank liquid level percentages depending on the particular devices or techniques that are being used to measure the level of liquid in the flash tank.

In an exemplary embodiment, the level of liquid in the flash tank can be measured using a capacitance probe and the predetermined flash tank liquid level percentage corresponds to an amount of liquid covering the probe or rod. For example, a predetermined flash tank liquid level percentage of 50% would correspond to 50% of the probe or rod being covered or submersed in liquid. In addition, depending on the configuration of the probe, there can be multiple liquid levels in the flash tank that correspond to 0% (no part of the probe is covered) and 100% (the entire probe is covered). The predetermined flash tank liquid level percentage can be between about 0% and about 100% and in one embodiment can be between about 15% and about 85% and in another embodiment can be about 75%.

If the VSD output frequency is greater than the first predetermined frequency and the level of liquid refrigerant in the flash tank 110 is less than the predetermined flash tank liquid level percentage, then the economizer port valve 120 is turned "on" or opened to engage the economizer circuit (step 206) and the control process restarts. When the VSD output frequency is greater than the first predetermined frequency and the level of liquid refrigerant in the flash tank 110 is less than the predetermined flash tank liquid level percentage, the conditions in the system 100 are appropriate for the engaging of the economizer circuit to increase the performance of the system 100. In particular, the system 100 is operating at an appropriate compressor speed and the flash tank 110 has a liquid level that should not permit liquid refrigerant to be drawn into the compressor 102 during operation of the economizer circuit. If the VSD output frequency is not greater than the first predetermined frequency or if the level of liquid refrigerant in the flash tank 110 is not less than the predetermined flash tank liquid level percentage, then a determination is made as to whether the VSD output frequency is less than a second predetermined frequency (step 210). The second predetermined frequency can be between about 50 Hz and about 200 Hz and in one embodiment can be about 100 Hz. In response to the VSD output frequency being less than the second predetermined frequency, the economizer port valve can be turned "off" or closed (step 208) and the control process restarts. When the VSD output frequency is less than a second predetermined frequency, the conditions in the system 100 are no longer appropriate for the economizer circuit to provide increased system performance. If the VSD output frequency is greater than the second predetermined frequency, the control process restarts and does not change the configuration of the economizer port valve 120.

Figure 3:
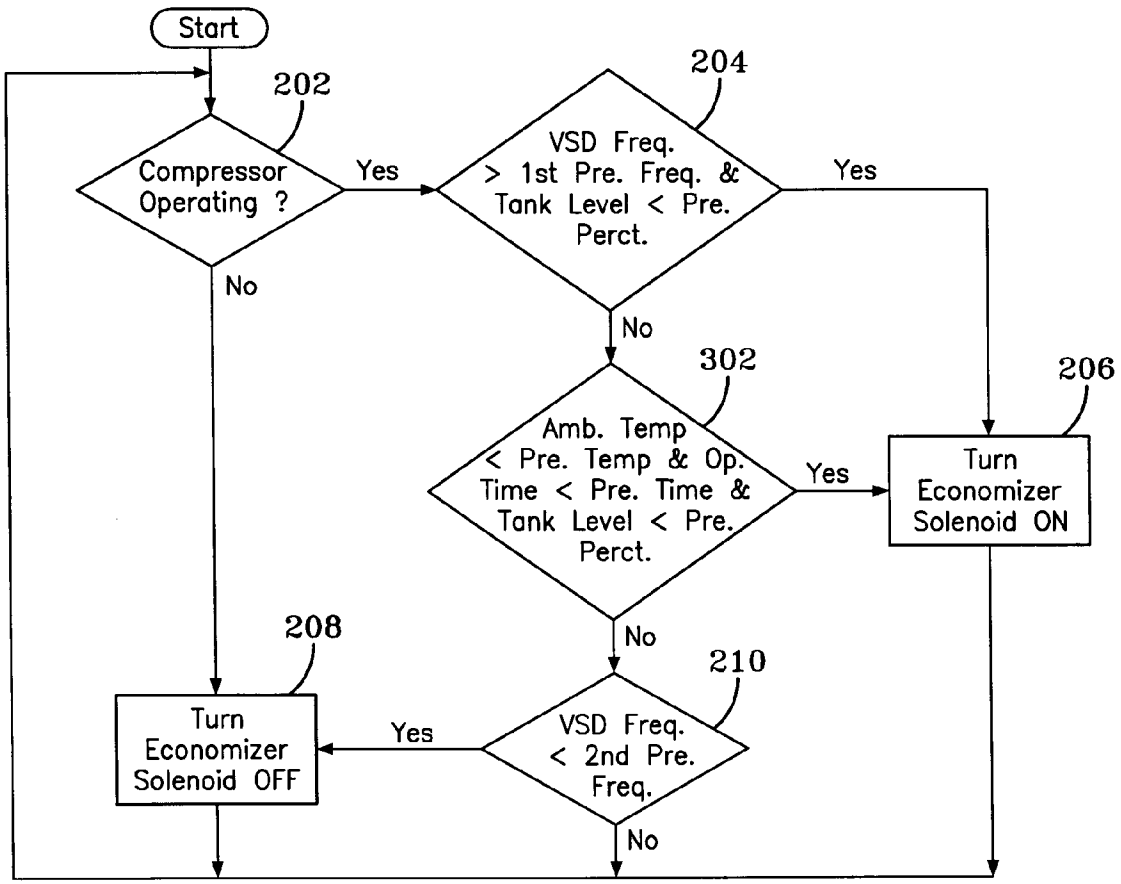
FIG. 3 is a flowchart showing another embodiment of an economizer port valve control process.

FIG. 3 illustrates another embodiment of the economizer port valve control process. The valve control process of FIG. 3 is similar to the valve control process of FIG. 2 and to simplify the description of the control process only the differences between the control processes of FIG. 2 and FIG. 3 are described. The control process of FIG. 3 differs from the control process of FIG. 2 in that an additional step is provided between step 204 and step 210. In response to the VSD 122 providing an output frequency to the motor 124 and compressor 102 less than a first predetermined frequency or the level of liquid refrigerant in the flash tank 110 being greater than a predetermined flash tank liquid level percentage, a determination is made as to whether the outdoor ambient temperature is less than a predetermined temperature, the operating time of the compressor is less than a predetermined time period and the level of liquid refrigerant in the flash tank 110 is less than the predetermined flash tank liquid level percentage (step 302). The predetermined temperature can be between about 20° F. and about 70° F. and in one embodiment can be about 40° F. The predetermined time period can be between about 1 minute and about 10 minutes and in one embodiment can be about 5 minutes.

If the outdoor ambient temperature is less than the predetermined temperature, the operating time of the compressor is less than the predetermined time period and the level of liquid refrigerant in the flash tank 110 is less than the predetermined flash tank liquid level percentage, then the economizer port valve 120 is turned "on" or opened to engage the economizer circuit (step 206) and the control process restarts. The economizer circuit can be engaged in response to the outdoor ambient temperature being less than the predetermined temperature, the operating time of the compressor being less than the predetermined time period and the level of liquid refrigerant in the flash tank 110 being less than the predetermined flash tank liquid level percentage in order to provide improved performance during system start-up at low ambient temperature conditions. The improved performance at low ambient temperatures is provided by increasing the refrigerant flow rate through the system 100 by using the economizer circuit to get the system pressures to the "steady state" system pressures and to avoid possible system shutdowns for low pressure or oil pressure faults. If the outdoor ambient temperature is greater than the predetermined temperature, the operating time of the compressor is greater than the predetermined time period or the level of liquid refrigerant in the flash tank 110 is greater than the predetermined flash tank liquid level percentage, then control process proceeds to step 210 as described in detail above with respect to FIG. 2.

Figure 4:
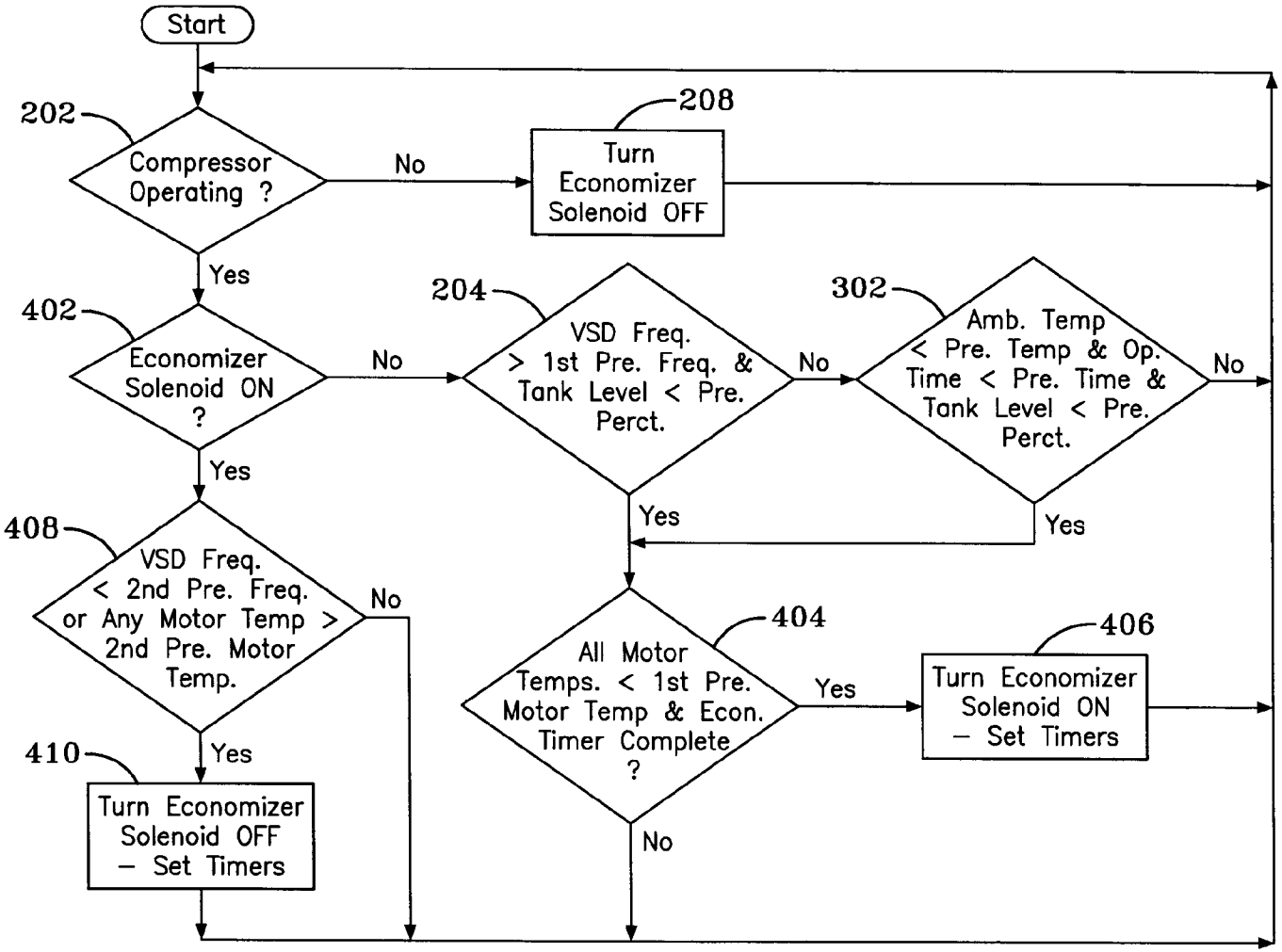
FIG. 4 is a flowchart showing still another embodiment of an economizer port valve control process.

FIG. 4 illustrates a further embodiment of the economizer port valve control process. The valve control process of FIG. 4 includes similar steps as in the valve control processes of FIGS. 2 and 3. The process in FIG. 4 begins by determining if the compressor 102 is in operation (step 202). If the compressor 102 is not operating, then the economizer port valve 120 is turned "off" or closed to disengage the economizer circuit (step 208) and the control process restarts. However, if the compressor 102 is in operation, then a determination is made as to whether the economizer port valve 120 is "on" or opened (step 402).

If the economizer port valve 120 is "off" or closed, then a determination is made as to whether the VSD 122 is providing an output frequency to the motor 124 and compressor 102 greater than a first predetermined frequency and whether the level of liquid refrigerant in the flash tank 120 is less than a predetermined flash tank liquid level percentage (step 204). The first predetermined frequency can be between about 50 Hz and about 200 Hz and in one embodiment can be about 120 Hz. The predetermined flash tank liquid level is determined as discussed in detail above and in one embodiment can be about 75%.

In response to the VSD 122 providing an output frequency to the motor 124 and compressor 102 less than a first predetermined frequency or the level of liquid refrigerant in the flash tank 110 being greater than a predetermined flash tank liquid level percentage, a determination is made as to whether the outdoor ambient temperature is less than a predetermined temperature, the operating time of the compressor is less than a predetermined time period and the level of liquid refrigerant in the flash tank 110 is less than the predetermined flash tank liquid level percentage (step 302). The predetermined temperature can be between about 20° F. and about 70° F. and in one embodiment can be about 40° F. The predetermined time period can be between about 1 minute and about 10 minutes and in one embodiment can be about 5 minutes. If the outdoor ambient temperature is greater than a predetermined temperature, the operating time of the compressor is greater than a predetermined time period or the level of liquid refrigerant in the flash tank 110 is greater than the predetermined flash tank liquid level percentage, then the control process restarts and does not change the configuration of the economizer port valve 120.

If the outdoor ambient temperature is less than the predetermined temperature, the operating time of the compressor is less than the predetermined time period and the level of liquid refrigerant in the flash tank 110 is less than the predetermined flash tank liquid level percentage or if the VSD output frequency is greater than the first predetermined frequency and the level of liquid refrigerant in the flash tank 110 is less than the predetermined flash tank liquid level percentage, then a determination is made as to whether the temperature of the motor 124 is less than a first predetermined motor temperature or, if more than one refrigerant circuit with an economizer circuit is being used, the temperature of each of the motors 124 is less than the first predetermined motor temperature and whether an economizer timer has finished (step 404). The first predetermined motor temperature can be between about 120° F. and about 200° F. and in one embodiment can be about 150° F. The checking of the motor temperature is conducted to avoid a high motor temperature trip resulting from the operation of the economizer which can drastically raise the temperature of the motor 124. The checking of economizer timer is conducted to avoid frequent cycling of the economizer circuit that can result in instability of the system. If the motor temperature(s) are greater than the first predetermined motor temperature or if the economizer timer has not finished or completed, then the control process restarts and does not change the configuration of the economizer port valve 120.

If the motor temperature(s) are less than the first predetermined motor temperature and the economizer timer has finished, then the economizer port valve 120 is turned "on" or opened to engage the economizer circuit and a load timer and an economizer timer are set (step 406) and the control process restarts. If more than one refrigerant circuit with an economizer circuit is being used, all of the economizer timers are set in step 406. The setting of all economizer timers in step 406 can also prevent more than one economizer from turning "on" at a time, thereby permitting the system capacity control algorithm to react to the system changes from engaging the economizer circuit. The economizer timer(s) can be set for about 10 seconds to about 90 seconds and in one embodiment can be set for 30 seconds, if the economizer timer is not already at a time greater than the time to be set in step 406. The load timer is provided as an input to the capacity control algorithm and can be set for about 10 seconds to about 90 seconds and in one embodiment can be set for 30 seconds.

If the economizer port valve 120 is "on" or opened, then a determination is made as to whether the VSD output frequency is less than a second predetermined frequency and whether the temperature of the motor 124 is greater than a second predetermined motor temperature or, if more than one refrigerant circuit with an economizer circuit is being used, the temperature of any of the motors 124 is greater than the second predetermined motor temperature (step 408). The second predetermined frequency can be between about 50 Hz and about 200 Hz and in one embodiment can be about 100 Hz. The second predetermined motor temperature can be between about 200° F. and about 300° F. and in one embodiment can be about 240° F. In response to the VSD output frequency being less than the second predetermined frequency or the motor(s) temperature being greater than the second predetermined motor temperature, the economizer port valve can be turned "off" and an unload timer and an economizer timer are set (step 410) and the control process restarts. The unload timer is provided as an input to the capacity control algorithm and can be set for about 10 seconds to about 90 seconds and in one embodiment can be set for 30 seconds. The economizer time can be set for about 100 seconds to about 500 seconds and in one embodiment can be set for 300 seconds.

Figure 5:
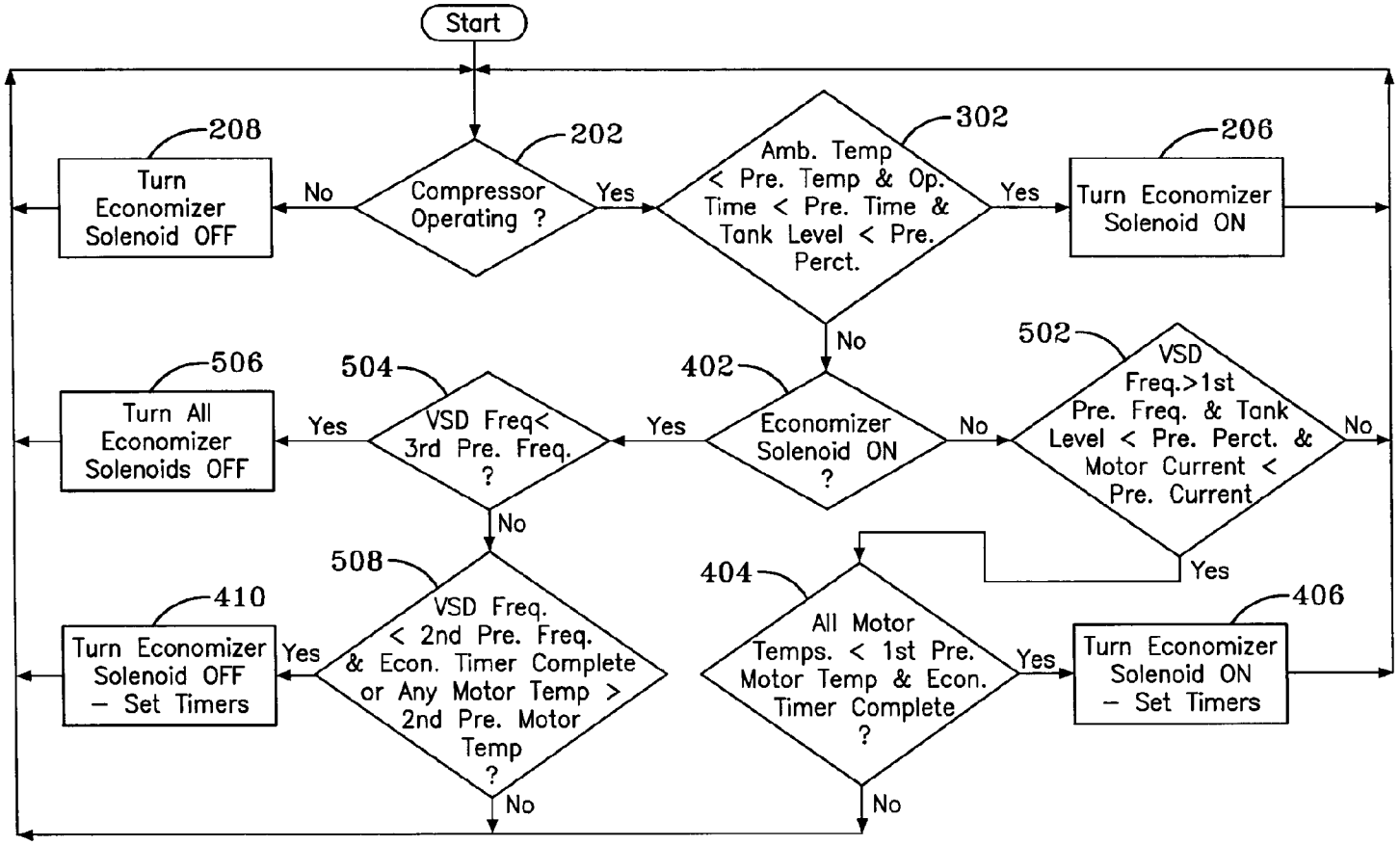
FIG. 5 is a flowchart showing a further embodiment of an economizer port valve control process.

FIG. 5 illustrates an additional embodiment of the economizer port valve control process. The valve control process of FIG. 5 includes similar steps as in the valve control processes of FIGS. 2-4. The process in FIG. 5 begins by determining if the compressor 102 is in operation (step 202). If the compressor 102 is not operating, then the economizer port valve 120 is turned "off" or closed to disengage the economizer circuit and the economizer timer is set to zero (step 208) and the control process restarts. However, if the compressor 102 is in operation, then a determination is made as to whether the outdoor ambient temperature is less than a predetermined temperature, the operating time of the compressor is less than a predetermined time period and the level of liquid refrigerant in the flash tank 110 is less than the predetermined flash tank liquid level percentage (step 302). The predetermined temperature can be between about 20° F. and about 70° F. and in one embodiment can be about 40° F. The predetermined time period can be between about 1 minute and about 10 minutes and in one embodiment can be about 5 minutes. If the outdoor ambient temperature is less than a predetermined temperature, the operating time of the compressor is less than a predetermined time period and the level of liquid refrigerant in the flash tank 110 is less than the predetermined flash tank liquid level percentage, then the economizer port valve 120 is turned "on" or opened thereby engaging the economizer circuit (step 206) and the control process restarts.

If the outdoor ambient temperature is not less than the predetermined temperature or the operating time of the compressor is not less than the predetermined time period or the level of liquid refrigerant in the flash tank 110 is not less than the predetermined flash tank liquid level percentage, then a determination is made as to whether the economizer port valve 120 is "on" or opened (step 402). If the economizer port valve 120 is "off" or closed, then a determination is made as to whether the VSD 122 is providing an output frequency to the motor 124 and compressor 102 greater than a first predetermined frequency, whether the level of liquid refrigerant in the flash tank 110 is less than a predetermined flash tank liquid level percentage, and whether the motor current is less than a predetermined motor current (step 502). The first predetermined frequency can be between about 50 Hz and about 200 Hz and in one embodiment can be about 120 Hz. The predetermined flash tank liquid level is determined as discussed in detail above and in one embodiment can be about 75%. The predetermined motor current can be between about 50% and about 95% of the full load motor current for the motor 124 and in one embodiment can be about 80% of the full load motor current.

In response to the VSD 122 providing an output frequency to the motor 124 and compressor 102 less than a first predetermined frequency, the level of liquid refrigerant in the flash tank 110 being greater than a predetermined flash tank liquid level percentage, or the motor current being greater than a predetermined motor current, control process restarts and does not change the configuration of the economizer port valve 120. Otherwise, a determination is made as to whether the temperature of the motor 124 is less than a first predetermined motor temperature or, if more than one refrigerant circuit with an economizer circuit is being used, the temperature of each of the motors 124 is less than the first predetermined motor temperature and whether an economizer timer has finished (step 404). The first predetermined motor temperature can be between about 120° F. and about 200° F. and in one embodiment can be about 150° F. The checking of the motor temperature is conducted to avoid a high motor temperature trip resulting from the operation of the economizer, which can raise the temperature of the motor 124. The checking of economizer timer is conducted to avoid frequent cycling of the economizer circuit that can result in instability of the system. If the motor temperature(s) are greater than the first predetermined motor temperature or the economizer timer has not finished or completed, then the control process restarts and does not change the configuration of the economizer port valve 120.

If the motor temperature(s) are less than the first predetermined motor temperature and the economizer timer has finished, then the economizer port valve 120 is turned "on" or opened to engage the economizer circuit and a load timer and an economizer timer are set (step 406) and the control process restarts. If more than one refrigerant circuit with an economizer circuit is being used, then step 406 sets all of the economizer timers. The setting of all economizer timers in step 406 can also prevent more than one economizer from turning "on" at a time, thereby permitting the system capacity control algorithm to react to the system changes from engaging the economizer circuit. The economizer timer(s) can be set for about 10 seconds to about 90 seconds and in one embodiment can be set for 30 seconds, if the economizer timer(s) is not already at a time greater than the time to be set in step 406. The load timer is provided as an input to the capacity control algorithm and can be set for about 10 seconds to about 90 seconds and in one embodiment can be set for 35 seconds.

If the economizer port valve 120 is "on" or opened, then a determination is made as to whether the VSD 122 is providing an output frequency to the motor 124 and compressor 102 that is less than a third predetermined frequency (step 504). The third predetermined frequency can be between about 50 Hz and about 100 Hz and in one embodiment can be about 90 Hz. In response to the VSD 122 providing an output frequency to the motor 124 and compressor 102 that is less than a third predetermined frequency, the economizer solenoid is tuned off and the economizer timer is set to zero, or if more than one refrigerant circuit with an economizer circuit is being used, then all of the economizer solenoids are turned off and the corresponding economizer timers are set to zero (step 506).

If the output frequency to the motor 124 is not less than the third predetermined frequency, a determination is made as to whether the VSD output frequency is less than a second predetermined frequency, whether the economizer timer has completed, and whether the temperature of the motor 124 is greater than a second predetermined motor temperature or, if more than one refrigerant circuit with an economizer circuit is being used, the temperature of any of the motors 124 is greater than the second predetermined motor temperature (step 508). The second predetermined frequency can be between about 50 Hz and about 200 Hz and in one embodiment can be about 100 Hz. The second predetermined motor temperature can be between about 200° F. and about 300° F. and in one embodiment can be about 240° F.

In response to the VSD output frequency being less than the second predetermined frequency and the economizer timer having completed, or the motor(s) temperature being greater than the second predetermined motor temperature, the economizer port valve can be turned "off" and an unload timer and an economizer timer can be set (step 410) and the control process restarts. If more than one refrigerant circuit with an economizer circuit is being used, then step 410 sets all of the economizer timers. The economizer timer can be set for about 20 seconds to about 300 seconds and in one embodiment can be set for 60 seconds. The other economizer timers can be set for about 10 seconds to about 90 seconds and are preferably set for 30 seconds, if the economizer timers are not already at a time greater than the time to be set in step 410. The unload timer is provided as an input to the capacity control algorithm and can be set for about 10 seconds to about 90 seconds and in one embodiment can be set for 30 seconds. However, if the VSD output frequency is greater than the second predetermined frequency or the economizer timer has not completed, or the motor(s) temperature is less than the second predetermined motor temperature, the control process restarts and does not change the configuration of the economizer port valve 120.

In an exemplary embodiment, the economizer circuit can be engaged and disengaged in response to predetermined compressor loading or capacity thresholds, e.g., a slide valve position, instead of the VSD output frequency thresholds described above. Furthermore, additional predetermined criteria can be incorporated into the economizer port valve control processes and would provide additional opportunities to control the engaging and disengaging of the economizer circuit. The satisfaction of the additional predetermined criteria can result in further refinements as to when to engage and disengage the economizer circuit.

In another exemplary embodiment, one or more of the first predetermined frequency, the predetermined flash tank liquid level percentage, the second predetermined frequency, the predetermined temperature, the first predetermined motor temperature, the second predetermined motor temperature and the predetermined time period can be set or adjusted by a user to a desired value. In another embodiment, the first predetermined frequency, the predetermined flash tank liquid level percentage, the second predetermined frequency, the predetermined temperature, the first predetermined motor temperature, the second predetermined motor temperature and the predetermined time period are preset and cannot be changed or adjusted by the user.

In still another embodiment utilizing more than one refrigerant circuit with an economizer circuit, all of the corresponding economizer solenoids can be turned off in response to any of the compressors in any of the refrigerant circuits changing states. For example, the compressor switching from the off state to the on state would trigger the closing of all of the economizer solenoids to possibly avoid damage to the VSD or the other motors. In addition, the economizer solenoids can also be incrementally or variably opened or closed over several iterations of the control process to provide a smoother control operation and a greater level of control over the operation of the system 100.

In an exemplary embodiment, economizer capacity can be modulated to prevent a condition that may exceed the compressor or system design limits. Some examples of compressor or system conditions include high motor current, high motor temperature, high flash tank level, high discharge pressure, and high discharge temperature.

Figure 6:
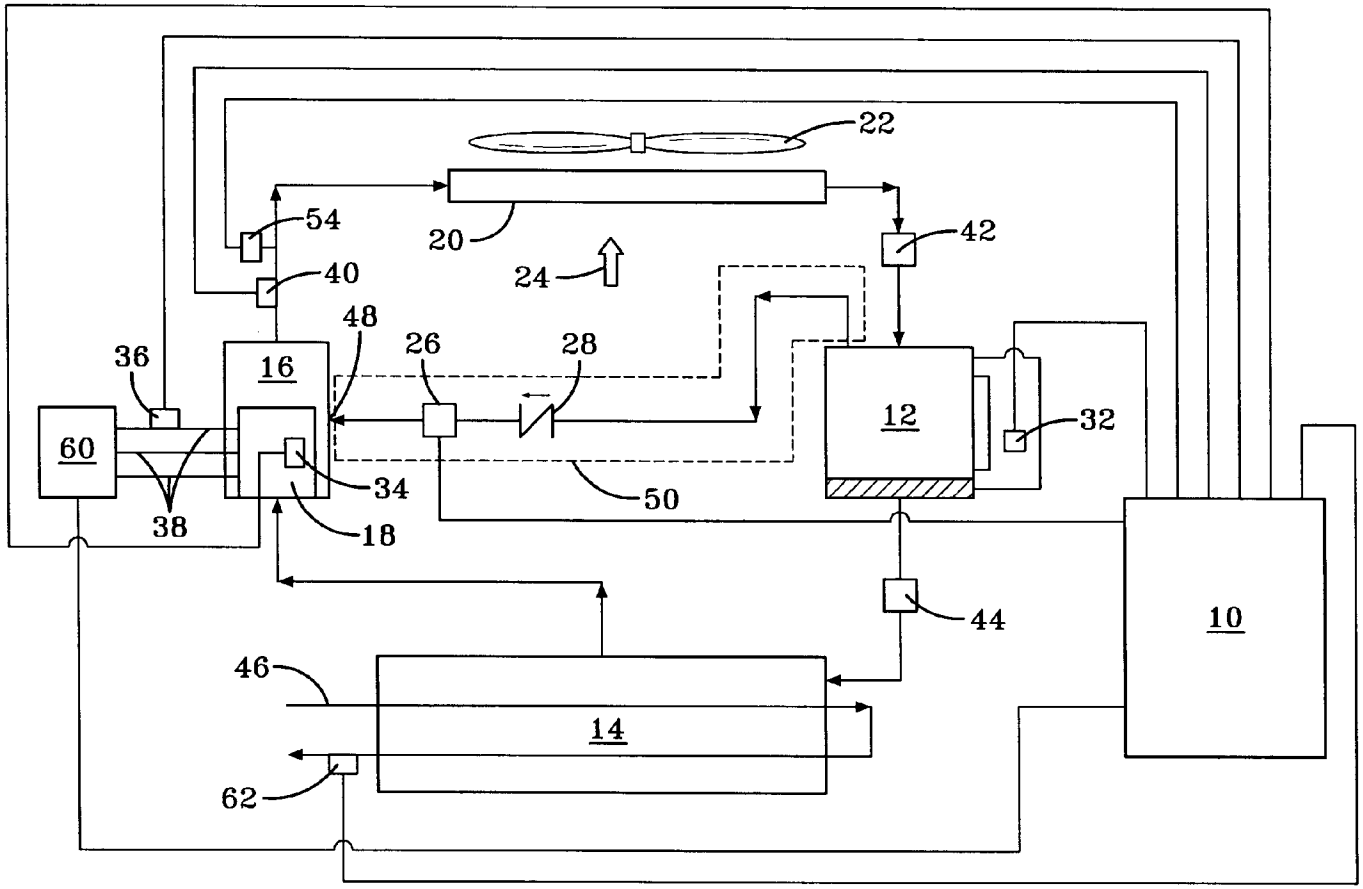
FIGS. 6 and 7 show additional embodiments of vapor compression systems.

FIG. 6 shows an embodiment of a vapor compression system with a flash tank economizer. A compressor 16, a condenser 20, a flash tank 12, and an evaporator 14 are connected with piping to form a refrigerant loop. The flash tank 12 and compressor 16 are also connected through an economizer line 50 that includes an economizer valve 26, an optional check valve 28, and a compressor economizer connection 48. A first expansion device 42 is located between the condenser 20 and the flash tank 12, and a second expansion device 44 is located between the flash tank 12 and the evaporator 14.

In one exemplary embodiment, the economizer valve can have a stepper motor, such as model ETS-400 from Danfoss, which model can be used as an electronic expansion valve. The controller can send a zero to 5 VDC signal to a driver for the valve that then steps the valve open or closed to the desired position.

The compressor 16 pumps refrigerant vapor from the evaporator 14 to the condenser 20, which cools the vapor to produce refrigerant liquid. The liquid exits the condenser 20 and passes or travels through the first expansion device 42 which reduces the refrigerant pressure to create a mixture of liquid and vapor that flows into the flash tank 12. The flash tank 12 separates the refrigerant liquid and vapor. The vapor exits from the flash tank 12 and flows through the check valve 28, the economizer valve 26, and compressor economizer connection 48 which are part of the economizer line 50. The refrigerant liquid exits from the flash tank 12 through the second expansion device 44 which creates a pressure drop which creates a two phase flow into the evaporator 14. Liquid refrigerant boils in the evaporator cooling a fluid 46 and becomes refrigerant vapor that flows back to the suction end of the compressor 16 to complete the refrigerant loop.

In one embodiment, the control system or algorithm can use refrigerant subcooling leaving the condenser to control the first expansion device 42 and can use a fixed orifice for the second expansion device 44. Details related to the controls for this embodiment are provided in U.S. patent application Ser. No. 12/846,959, titled, "Refrigerant Control System and Method," and filed on Jul. 30, 2010, which application is incorporated by reference herein.

As shown in FIG. 6, the condenser 20 is cooled by an air stream 24 created by the action or operation of a fan(s) 22. Alternate configurations can use liquid-cooled condensers with associated cooling towers, radiators, ground loops or heat-rejection systems. In the evaporator, the fluid piping 46 can circulate water or other liquid. In another embodiment, air or other gas can be used for heat transfer with the refrigerant in the evaporator 14.

A controller 10 can be in communication with multiple sensors which enable the controller 10 to determine the operation of the economizer valve 26. In one embodiment, the controller can determine the position of the economizer valve 26 at a predetermined interval, e.g., about every 2 seconds. A leaving fluid temperature sensor 62 downstream of the evaporator 14, provides a control input that the controller 10 uses to determine the required cooling capacity. The controller 10 provides a signal to a variable speed drive 60 to increase compressor speed in response to a leaving fluid temperature that is above a predetermined setpoint. Once a predetermined speed of the compressor is reached or obtained, the controller provides a signal to open the economizer valve 26. If the measured leaving fluid temperature drops below the setpoint, the controller 10 gradually reduces compressor speed and eventually closes the economizer valve 26. In one exemplary embodiment, the controller 10 can open the economizer valve 26 at 120 Hz and close the economizer valve 26 at 100 Hz compressor input frequency. Full speed for the compressor can correspond to a frequency in the range between 170 and 210 Hz.

Additional sensors permit the controller 10 to respond to conditions that are at or near predetermined operating limits for the compressor 16 or other components in the system. These sensors include a level sensor 32, which senses refrigerant liquid level in the flash tank 12. The level sensor can be a level switch that opens to indicate a high liquid level. Alternatively a level sensor with a continuous output may be used. Additional sensors can be located on the refrigerant line between the discharge of the compressor 16 and the condenser 20. These sensors include a discharge-pressure sensor 54 and a discharge temperature sensor 40.

There are also sensors related to a compressor motor 18 that drives the pumping mechanism of the compressor 16. The compressor motor 18 can be a variable-speed, refrigerant-cooled, hermetic motor located within the housing of compressor 16. Alternatively, the compressor motor 18 may be an air-cooled motor that is outside the compressor housing with a shaft seal to provide the necessary containment of refrigerant. The controller 10 is in communication with a motor temperature sensor 34. In addition a motor current sensor 36 measures electrical current in at least one of the conductors 38 that supply power to the compressor motor 18 from a variable frequency or variable speed drive 60. The economizer valve 26 can be a modulating valve that can open and close in small steps that approximates continuous control over valve position. Alternatively the economizer valve 26 may incorporate multiple solenoid valves connected in parallel to provide steps of control. For example, two solenoids connected in parallel with about a 2 to 1 ratio in flow capacity can give four steps of control (0, 0.5, 1.0, and 1.5 times of the flow capacity of the larger valve) using simple on-off control of the solenoids. For example, if the valve capacities are 1.0 and 0.5 (relative to the capacity of the larger valve) then the total capacity is 1.5 of the capacity of the larger valve when both valves are open. If only the larger valve is open, then the capacity is 1.0. If only the smaller valve is open, then the capacity is 0.5. If both valves are closed then the capacity is zero.

In an exemplary embodiment, the control system or controller 10 can close and/or stop opening the economizer valve 26 in response to sensor inputs that show that the system is at or near a limiting condition. For example, if the level sensor 32 shows a flash tank liquid level above a predetermined limit, the controller 10 closes the economizer valve 26. If the liquid level then drops below a predetermined value, the controller 10 stops closing the economizer valve 26. The controller 10 may then periodically open the economizer valve 26 slowly until the flash tank 12 starts to fill above the limit and then close the valve until the level drops to an acceptable level. This approach permits the use of a simple level switch to sense flash tank level.

Similar controls are possible for compressor discharge pressure, discharge temperature, motor current, and motor temperature. As the sensed parameter approaches a first predetermined value or limit, the controller inhibits opening of the economizer valve. If the value of the parameter continues to increase above a second predetermined value, the controller then starts to close the economizer valve. The rate of closure can be proportional to the difference between the value of the parameter and the second predetermined value, i.e., the amount the measured value is greater than the second predetermined value. Finally the controller 10 may shut down the compressor 16 if the value exceeds a third predetermined value.

In one embodiment, the sensed parameter can relate to the maximum capacity that the compressor 16 or compressor motor 18 can provide for continuous operation without damage. For example, the maximum motor temperature is set by the properties of the motor insulation material. The maximum discharge pressure is based on a maximum working pressure and can be consistent with the design strength of the compressor housing, condenser, oil separator, flash tank, etc. Motor current limit is based on temperature and current limits for the variable speed drive, wiring, and motor. Flash tank liquid level is based on preventing excessive liquid carryover into the compressor economizer port or connection 48 and also ensuring that there is adequate refrigerant available for proper evaporator and condenser operation.

Figure 7:
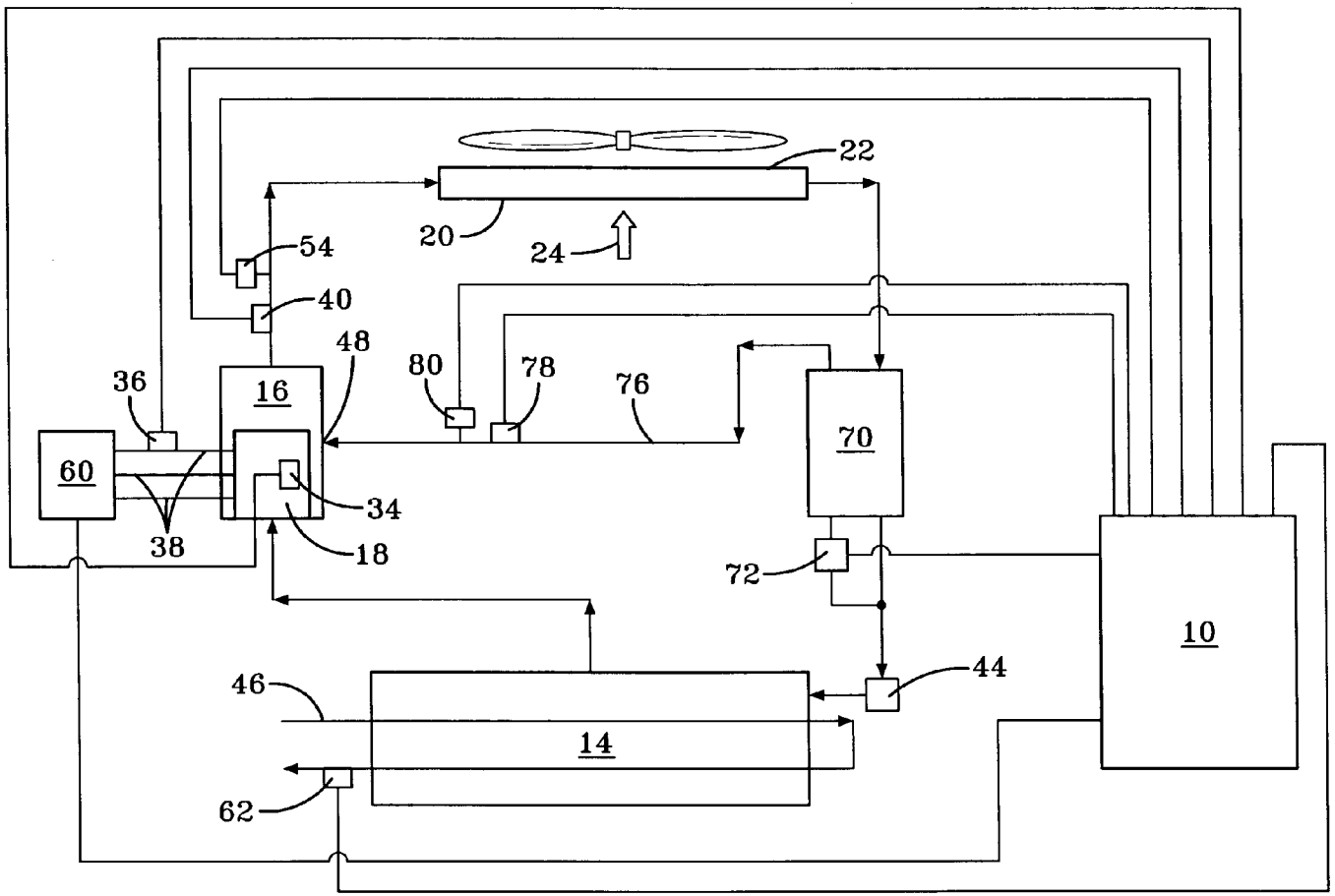

While the embodiment shown in FIG. 6 is designed to use a flash tank economizer, it is also possible to apply similar controls to economizers with a heat exchanger 70 as shown in FIG. 7. One difference from FIG. 6 is that instead of an economizer valve on the vapor line leaving the economizer, an economizer valve 72 would serve as an expansion valve on the inlet to the boiling side of the heat exchanger. Instead of a liquid level sensor, a pressure sensor 80 and temperature sensor 78 on the economizer line 76 between the heat exchanger 70 and the compressor 16 permit the controller 10 to control valve position on vapor superheat leaving the heat exchanger 70.

In one embodiment, a control algorithm for controlling an economizer circuit in a chiller system opens and closes a port valve in the economizer circuit in response to predetermined criteria to engage and disengage the economizer circuit. The predetermined criteria can include an operating parameter of a compressor and a level of liquid refrigerant in a flash tank.

In an exemplary embodiment, a modulated economizer control can be used to modulate the position of the economizer valve to prevent a condition in the system from exceeding a predetermined limit. The system conditions or operating parameters can include flash tank liquid level, compressor motor current, compressor motor temperature, compressor discharge temperature and compressor discharge pressure. Specifically, the modulated economizer control can incrementally close the economizer valve in response to one or more of the system conditions exceeding a predetermined value associated with that system condition. The closure amount for the economizer valve when the system condition exceeds the predetermined value can be a fixed amount, e.g., the valve closes 10% on every cycle. In another embodiment, the closure amount for the economizer valve when the system condition exceeds the predetermined value can be variable amount based on or proportional to the difference between the measured system condition and the predetermined value. In other words, the greater the difference between the measured system condition and the predetermined value, the greater the closure amount for the valve. The predetermined value associated with a system condition can be less than the corresponding value of the system condition that will initiate a system shutdown. By reducing compressor capacity from the throttling of the flow through the economizer line, undesirable system conditions can be avoided without the substantially drop in compressor capacity associated with the implementing of a full closure of the economizer valve and the removal of the economizer circuit from the system.

In one embodiment with the economizer valve at a 0% or fully closed position, the controller can enable motor current limiting and prevent opening of the economizer valve if the flash tank level is above a predetermined level regardless of compressor frequency. In addition, the controller can open the economizer valve at a predetermined rate, e.g., 1% every 2 seconds, in response to the flash tank level being below the predetermined level and the compressor frequency being above a predetermined frequency, e.g., 120 Hz.

In another embodiment with the economizer valve at a position greater than 0%, i.e., at least partially open, the controller can disable motor current limiting and can close the economizer valve at a predetermined rate, e.g., 10% every 2 seconds, in response to the flash tank level being above a predetermined level. In addition, the controller can prevent closing of the economizer valve and start a timer for a predetermined time period, e.g., 5 minutes, in response to the flash tank level being below the predetermined level.

In still another embodiment, the economizer valve can be opened or closed based on motor current or motor temperature.

While the exemplary embodiments illustrated in the figures and described herein are presently preferred, it should be understood that these embodiments are offered by way of example only. Other substitutions, modifications, changes and omissions may be made in the design, operating conditions and arrangement of the exemplary embodiments without departing from the scope of the present application. Accordingly, the present application is not limited to a particular embodiment, but extends to various modifications that nevertheless fall within the scope of the appended claims. It should also be understood that the phraseology and terminology employed herein is for the purpose of description only and should not be regarded as limiting.

Only certain features and embodiments of the invention have been shown and described in the application and many modifications and changes may occur to those skilled in the art (e.g., variations in sizes, dimensions, structures, shapes and proportions of the various elements, values of parameters, mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A system comprising:

a first circuit comprising a compressor having a motor, a condenser, an expansion valve and an evaporator connected in a closed refrigerant loop;

a second circuit connected to the first circuit, the second circuit comprising a vessel in fluid communication with the condenser, the evaporator and the compressor, and a valve positioned to control flow of refrigerant through the second circuit;

a sensor to measure an operating parameter of the system;

a controller, the controller comprising a connection to receive the measured operating parameter from the sensor and a microprocessor to execute a computer program to generate a signal to control a position of the valve based on the measured operating parameter from the connection; and the controller generating a signal to incrementally close the valve in response to the measured operating parameter being greater than a predetermined value associated with an operating limit of the measured operating parameter, the predetermined value being less than a corresponding value of the measured operating parameter that initiates a system shutdown.

2. The system of claim 1 wherein the measured operating parameter comprises at least one of a compressor motor temperature, a compressor motor current, a discharge temperature of the compressor or a discharge pressure of the compressor.

3. The system of claim 1 wherein the vessel comprises a heat exchanger.

4. The system of claim 3 wherein the valve is positioned on an inlet to a boiling side of the heat exchanger and operates as an expansion valve.

5. The system of claim 4 further comprises at least one additional sensor positioned between the heat exchanger and the compressor, the at least one additional sensor permits the controller to control valve position on vapor superheat leaving the heat exchanger.

6. The system of claim 5 wherein the at least one additional sensor is selected from the group consisting of a pressure sensor and a temperature sensor.

7. The system of claim 1 wherein the vessel comprises a flash tank and the measured operating parameter comprises a level of liquid in the flash tank.

8. The system of claim wherein the valve comprises a stepper motor to incrementally adjust the position of the valve.

9. The system of claim 1 wherein the controller determines a position of the valve at a predetermined interval.

10. The system of claim 1 wherein:

the predetermined value is a first predetermined value;

the controller generates a signal to inhibit opening the valve in response to the measured operating parameter approaching the first predetermined value;

the controller generates a signal to close the valve in response to the measured operating parameter being above a second predetermined value; and the controller generating a signal to shut down the compressor in response to the measured operating parameter being greater than a third predetermined value.

11. The system of claim 1 wherein the controller incrementally closes the valve by a fixed amount.

12. The system of claim 1 wherein the controller incrementally closes the valve by a variable amount based on or proportional to a difference between the measured operating parameter and the predetermined value.

13. The system of claim 1 wherein the valve incorporates multiple solenoid valves connected in parallel.

14. The system of claim 13 wherein the multiple solenoid valves provide steps of control using on-off control of the multiple solenoid valves.

* * * * *